US010386119B2

(12) United States Patent
Kannappel et al.

(10) Patent No.: US 10,386,119 B2
(45) Date of Patent: Aug. 20, 2019

(54) METHOD FOR OPERATING A SHAFT FURNACE

(71) Applicants: ThyssenKrupp Steel Europe AG, Duisburg (DE); ThyssenKrupp AG, Essen (DE)

(72) Inventors: Martin Kannappel, Dinslaken (DE); Rainer Klock, Essen (DE)

(73) Assignee: thyssenkrupp AG, Essen (DE)

( * ) Notice: Subject to any disclaimer, the term of this patent is extended or adjusted under 35 U.S.C. 154(b) by 15 days.

(21) Appl. No.: 15/123,895

(22) PCT Filed: Feb. 27, 2015

(86) PCT No.: PCT/EP2015/054173
§ 371 (c)(1),
(2) Date: Sep. 6, 2016

(87) PCT Pub. No.: WO2015/132159
PCT Pub. Date: Sep. 11, 2015

(65) Prior Publication Data

US 2017/0016673 A1 Jan. 19, 2017

(30) Foreign Application Priority Data

Mar. 5, 2014 (DE) ..... 10 2014 102 913

(51) Int. Cl.

| | |
|---|---|
| ***F27D 3/16*** | (2006.01) |
| ***C21C 5/00*** | (2006.01) |
| ***F27D 19/00*** | (2006.01) |
| ***F27B 1/16*** | (2006.01) |

(52) U.S. Cl.
CPC ..... *F27D 3/16* (2013.01); *C21C 5/00* (2013.01); *F27B 1/16* (2013.01); *F27D 19/00* (2013.01); *F27D 2003/163* (2013.01)

(58) Field of Classification Search
CPC ..... C21B 5/001; C21B 5/06
See application file for complete search history.

(56) References Cited

U.S. PATENT DOCUMENTS

| | | | | |
|---|---|---|---|---|
| 4,031,183 A | | 6/1977 | Rourke | |
| 5,350,439 A | * | 9/1994 | Ducrocq | B65G 53/528 266/221 |
| 8,173,064 B2 | * | 5/2012 | Konig | C21B 5/001 266/187 |

(Continued)

FOREIGN PATENT DOCUMENTS

| | | |
|---|---|---|
| CN | 201445868 U | 5/2010 |
| DE | 2149057 A | 4/1972 |

(Continued)

OTHER PUBLICATIONS

German Language International Search Report for PCT/EP2015/054173, dated Jun. 30, 2015.

(Continued)

*Primary Examiner* — Scott R Kastler
(74) *Attorney, Agent, or Firm* — RMCK Law Group PLC

(57) ABSTRACT

A method for operating a shaft furnace, in particular a blast furnace, is disclosed wherein at least one gas is introduced into the furnace. To achieve an acceleration of the reaction processes in the furnace, shockwaves are introduced into the furnace.

6 Claims, 1 Drawing Sheet

(56) References Cited

U.S. PATENT DOCUMENTS

| | | | | |
|---|---|---|---|---|
| 8,309,016 | B2 * | 11/2012 | Konig | C21B 5/06 266/197 |
| 8,444,910 | B2 * | 5/2013 | Konig | C21B 5/001 266/187 |
| 2008/0237944 | A1 | 10/2008 | Konig et al. | |
| 2012/0217684 | A1 * | 8/2012 | Konig | C21B 5/001 266/96 |

FOREIGN PATENT DOCUMENTS

| | | | | | |
|---|---|---|---|---|---|
| DE | 2610015 | C3 | | 9/1976 | |
| DE | 29711593 | U1 | | 9/1997 | |
| DE | 19835271 | A1 | | 2/2000 | |
| DE | 10117962 | B4 | | 10/2002 | |
| DE | 102 49 235 | A1 | | 5/2004 | |
| EP | 0978571 | A1 | | 2/2000 | |
| EP | 1948833 | B1 | | 9/2011 | |
| GB | 1350115 | A | | 4/1974 | |
| GB | 1367204 | A | * | 9/1974 | C21B 7/16 |
| JP | S47008152 | | | 4/1974 | |
| JP | 2000265205 | A | | 9/2000 | |
| JP | 2005241066 | A | | 9/2005 | |
| JP | 2009515049 | A | | 4/2009 | |
| SU | 904413 | A1 | | 7/1982 | |
| SU | 1368333 | A1 | | 1/1988 | |

OTHER PUBLICATIONS

English translation of International Search Report for PCT/EP2015/054173, dated Jun. 30, 2015.

Pipatmanomai S et al: "Investigation of coal conversion under conditions simulating the raceway of a blast furnace using a pulsed air injection. wire-mesh reactor". Energy & Fuels, American Chemical Society, Washington, DC, US, vol. 17. No. 2. Mar. 1, 2003 (Mar. 1, 2003), pp. 489-497, XP002442344, ISSN: 0887-0624. DOI: 10.1021/EF020175P abstract.

English Abstract of EP 0978571 A1.

Machine English translation of the Description section of DE 29711593 U1.

English Abstract of DE 19835271 A1.

English Abstract of DE 10117962 A1.

Russian Office Action for RU Application No. 2016139032/02 dated Nov. 20, 2018, 5 pages.

Translation of Japanese Office Action for JP Application No. 2016-555341 dated Mar. 5, 2019, 2 pages.

* cited by examiner

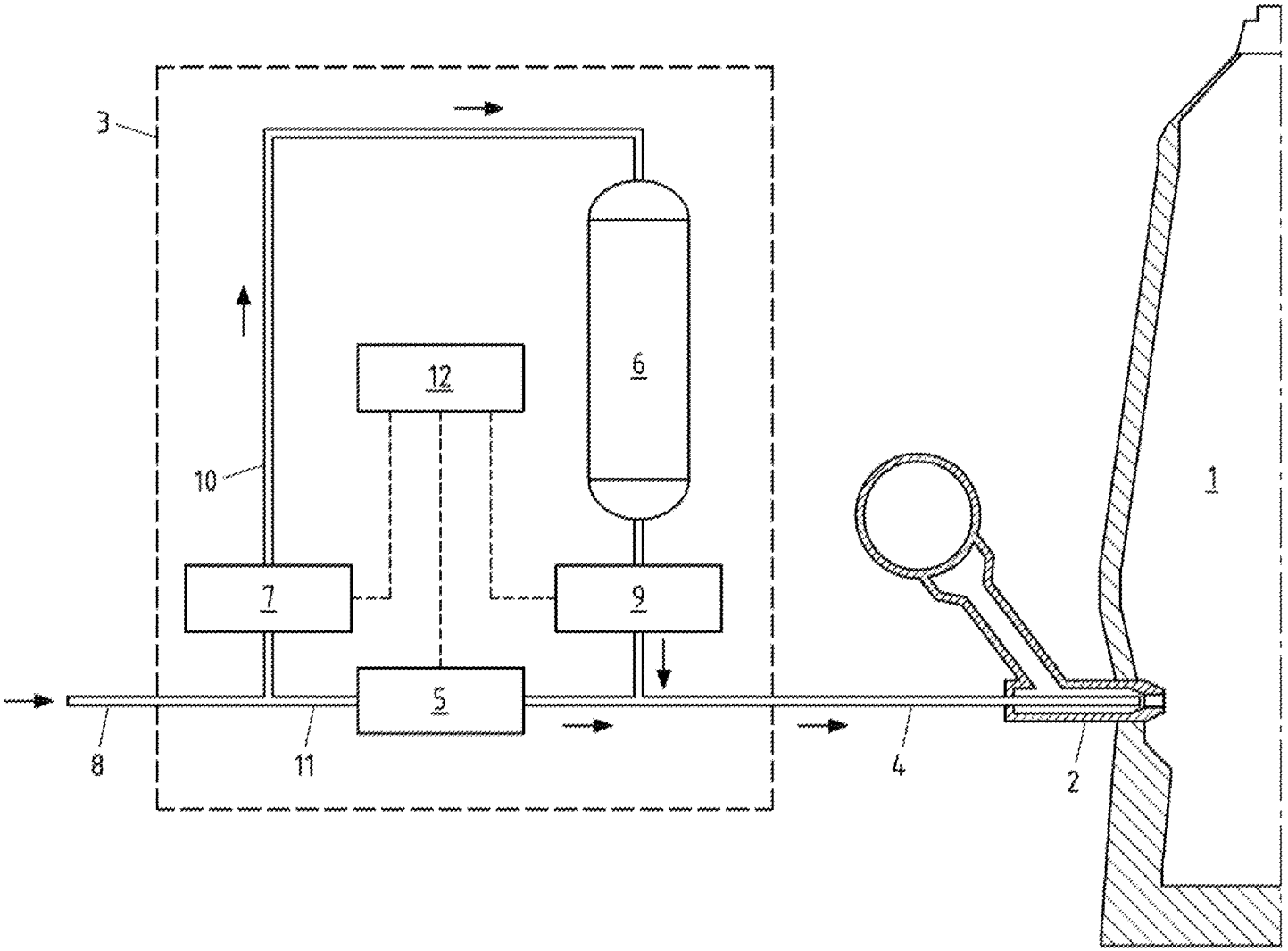
1
2
4
6
9
12
5
7
11
10
3
8

METHOD FOR OPERATING A SHAFT FURNACE

CROSS REFERENCE TO RELATED APPLICATIONS

This application is a U.S. National Stage Entry of International Patent Application Serial Number PCT/EP2015/054173, filed Feb. 27, 2015, which claims priority to German Patent Application No. DE 102014102913.5 filed Mar. 5, 2014, the entire contents of both of which are incorporated herein by reference.

FIELD

The invention relates to a method for operating a shaft furnace, in particular a blast furnace, wherein at least one gas is introduced into the furnace.

BACKGROUND

A shaft furnace is a furnace whose geometrical basic shape is "shaft-like". Typically, the height of shaft furnaces greatly exceeds their width and their depth. The basic shape of a shaft furnace often corresponds to a hollow cylinder, a hollow cone or a combination of both shapes. It is normally the case that combustion, reduction and melting processes occur in a shaft furnace, wherein the gases that are generated in the furnace rise upward. Shaft furnaces are utilized either for heating purposes or serve as a metallurgical plant for the generation of pure metals from ores, for the further processing of the metals, or for the production of other materials.

A special type of shaft furnaces are blast furnaces by means of which it is possible to produce liquid metal, normally raw iron, from ores in a continuous reduction and melting process. In relation to conventional shaft furnaces, blast furnaces place particular demands on the type of construction of the furnace, and in particular on the internal lining and cooling thereof, owing to the specific demands placed on the smelting of ores.

Blast furnaces are normally used as part of a complete integrated smelting works. Aside from the furnace itself, a blast furnace plant comprises, for example, transport devices for the filling ("feeding") of the blast furnace with input materials (e.g. iron ore and additives) and with reducing agents or energy carriers (e.g. coke) and devices for the extraction or discharging of the substances that form in the blast furnace (e.g. raw iron, slag, exhaust gases).

In many shaft furnaces, and in particular in blast furnaces, gases are introduced into the furnace from the outside in order to permit or influence the reactions taking place in the furnace. The gases may for example be air or pure oxygen. Devices for the injection of the gases commonly comprise ring lines which run around the furnace and which have multiple tuyeres or nozzles leading into the furnace interior and which additionally have lances that also lead into the furnace interior.

DE 101 17 962 B4 has disclosed, for example, a method for the thermal treatment of raw materials and a device for carrying out said method. The described device is a cupola furnace. Cupola furnaces are likewise shaft furnaces in which metals can be melted. By contrast to blast furnaces, cupola furnaces normally serve for the production of cast iron from raw iron and scrap metal, and accordingly differ from blast furnaces in terms of mode of operation and structural form.

In DE 101 17 962 B4, it is proposed that, in addition to an injection of air, gases with different oxygen content be alternatively introduced into the furnace. Said gases may be air and pure oxygen. For this purpose, two separate ring lines are led around the furnace. The first ring line is always filled with air, whereas the second ring line is alternatively filled with different gases (e.g. oxygen). Through the targeted introduction of gases with different oxygen content, it is the intention to control the reactions and in particular the temperatures in the furnace.

The solution presented in DE 101 17 962 B4 has the disadvantage of a cumbersome construction with multiple separate ring lines. Furthermore, the solution described in DE 101 17 962 B4 is restricted to cupola furnaces.

EP 1 948 833 B1 has disclosed a method for operating a shaft furnace. Said shaft furnace may be a cupola furnace or a blast furnace. In the solution described in EP 1 948 833 B1, too, it is proposed that a treatment gas, for example oxygen, be injected into the furnace.

It is the intention for the injected gas to be modulated in pulsed fashion. This means that, proceeding from a low base pressure, the pressure of the injected gas is briefly increased at time intervals. By way of this approach, it is sought to achieve better gas propagation in the furnace.

The solution described in EP 1 948 833 B1 has the disadvantage that, outside the "raceway", no reaction improvements, or only minor reaction improvements, are attained.

BRIEF DESCRIPTION OF THE DRAWINGS

FIG. 1 is a schematic view showing the construction of a plant for carrying out a method for operating a shaft furnace, as disclosed herein.

DETAILED DESCRIPTION

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

In one aspect of the method of the present disclosure, gasses are injected into the furnace such that an acceleration of the reaction processes in the furnace is achieved, in particular as far as into the region of the "deadman". In an embodiment of a method of the present disclosure, this is achieved by introducing shockwaves into the furnace.

A shockwave is a gas dynamics phenomenon in the case of which a compression shock forms the front of a compression wave. At the wavefront, the gradients of the state variables of pressure and temperature are so great that considerable molecular transport processes take place. The molecular transport processes are irreversible, that is to say the entropy of the gas encompassed by the wave increases. A discontinuous step change in state occurs, because the molecular transport processes are restricted to certain free path lengths. A shockwave spreads out with a propagation speed greater than the speed of sound of the static medium in front of the shockwave. In the case of intense shock waves with high shock Mach numbers, effects such as dissociation, electron excitation and ionization occur to an increasing extent.

Shockwaves can contribute significantly to the attainment of the thermodynamic or thermal conditions required for the execution of a chemical or physical-chemical reaction. In this way, it is possible to achieve even the activation energies for reactions in the furnace with inert carbon phases, for example phases with a high level of graphitization, or for the auto-ignition of combustible mixtures.

Compression shocks or shockwaves influence and massively intensify the local manifestation of turbulence. In this way, the formation of reactive mixtures and the necessary mass transfer for the respective chemical reactions in the shaft furnaces are positively influenced. This is of major significance in particular for the heterogeneous gas-solid matter reactions that take place, or the mass transfer between the solid and gaseous phases.

Owing to the surface structure and the porosity of particles, it is possible for high pressures and temperatures, even pressure and temperature gradients, to arise as a result of the diffraction and reflection behaviour of shockwaves within the particles. Depending on the particle size or structure and strength, it is possible for layers close to the surface, or the entire particle, to be destroyed owing to the occurring stresses. As a result of this process, a greater effective reaction surface is available for the chemical reactions.

Examples include coke particles whose outer layers have a high ash fraction or are covered by slag owing to the reactions that have taken place previously, and blown-in fine coals and the partially pyrolyzed residues thereof (e.g. char). The reaction kinetics are furthermore improved if a gas ("treatment gas") required for the chemical reactions in any case (e.g. oxygen or some other reaction gas) is used as gas for the generation of the shockwave ("propellant gas").

In the case of shockwaves interacting with small particles, the dispersion of said small particles in the gas phase is considerably improved, and the chemical conversion of said small particles is thus accelerated. This applies specifically for the injection of input materials with normally fine particle sizes. This is of particular significance if the pneumatic delivery thereof is realized in accordance with the dense-stream principle. An example that can be mentioned here is the injection of fine coals into shaft furnaces or blast furnaces.

In summary, by way of the introduction of shockwaves into shaft furnaces, it is possible for the reactions to be accelerated and intensified.

Shockwaves may be caused for example by way of detonations, lightning strikes or flying projectiles. For the generation of shockwaves for scientific purposes and other tests, use is made of shock channels or shock pipes. The generation of the shockwave is in this case realized by way of the exceedance of the burst pressure of a diaphragm which separates the high-pressure part, the propellant gas chamber, from the low-pressure part. The bursting of the diaphragm ensures the abrupt increase in pressure required for the generation of shockwaves.

In one refinement of the invention, it is provided that the shockwaves are triggered by opening a re-closable valve. This type of generation of the shockwaves has the advantage in relation to a bursting diaphragm that it is possible to generate as many shockwaves as desired in rapid succession without the need for a component to be exchanged or replaced for this purpose. However, a shockwave can be formed only at extremely fast-opening valves which open up the entire line cross section in a very short time. It is particularly advantageous for a gas (e.g. oxygen) which is required in any case for the operation of a shaft furnace, that is to say for the reaction processes, to be used as propellant gas for the shockwave.

With regard to this refinement of the invention, it is therefore also proposed that the valve is opened, preferably fully opened, in less than 6 ms, in particular in less than 4 ms. By virtue of the fact that an opening of the valve takes only a few milliseconds, an abrupt pressure increase is ensured, such as is required for the generation of shockwaves. Owing to their fast opening times, sliding gate valves have proven to be particularly suitable. By contrast, too slow an opening of the valve would have the effect that no shockwave can be generated owing to the pressure equalization that takes place.

A refinement of the invention provides that the valve is pneumatically controlled. The valves with very fast opening times required for the invention require a drive which operates at high speeds, and an actuation arrangement which meets these requirements. A pneumatic drive has proven to be particularly advantageous. Alternative drive types which meet these requirements may likewise be used (e.g. an electric motor, in particular a servomotor).

In a further refinement of the invention, it is proposed that a pressure reservoir, in particular a pressure vessel, with a gas pressure of at least 10 bar, in particular at least 20 bar, is used for the generation of the shockwaves. The furnace pressure or the blast pressure of shaft furnaces may lie only slightly above atmospheric pressure (that is to say 0.2 bar to 1 bar). Depending on the type of shaft furnace or the mode of operation thereof, it is normally the case that higher blast pressures of between 1 bar and 5 bar are required. Since very great pressure differences are required for the generation of shockwaves, it is preferable for a pressure vessel with an internal pressure of the stated magnitude to be provided.

A further teaching of the invention provides that a treatment gas required for the reaction processes in the furnace is used as gas for the generation of the shockwaves. In other words, it is proposed that the propellant gas required for the generation of the shockwaves is at the same time a treatment gas or a gas required for the reaction processes in the shaft furnace. As a result, the valve can remain open for longer than is required exclusively for the generation of a shockwave.

In a further embodiment of the invention, it is therefore proposed that the valve be held open for a time period in the range between 0.05 s and 0.7 s. The number of valve cycles and the length of the time period for which the valve is open determine the amount of treatment gas that is supplied to the shaft furnace. Corresponding adaptation is performed in a manner dependent on the treatment gas, the type of shaft furnace and the mode of operation thereof.

The generation of shockwaves or the intermittent introduction of the gas into the furnace does not rule out that a continuous introduction of the same gas or of some other gas into the furnace takes place at the same time. In other words, it may be provided that a continuous "base flow" (e.g. an oxygen base flow) with generated shockwaves, or with intermittently higher gas volume flows, is supplied to the furnace. With said base flow, it is furthermore for example possible for the amount of treatment gas supplied to the furnace to be set. Furthermore, it is thus possible for the required cooling action for the lances or the introduction point to be ensured in continuous fashion.

Finally, in a further refinement of the invention, it is provided that a gas with oxidizing action, in particular oxygen, is used as gas. The gas that is used may be carbon dioxide, air or some other gas, in particular oxygen. In shaft furnace processes, or in certain reaction zones, reducing conditions or reducing gases are required. Here, possible treatment gases are for example carbon monoxide or hydrogen. Gas mixtures with a reducing action, and mixtures and gases which impart a reducing action after a further intermediate reaction, may also be used.

FIG. 1 illustrates a schematic construction of a plant for carrying out the method according to the invention. A furnace 1 in the form of a blast furnace has, around its circumference, multiple lances 2 by way of which the introduction of shockwaves or the introduction of a treatment gas into the furnace 1 from the outside is realized. Ideally, the lances 2 are inserted into the tuyeres of the furnace 1. To influence or optimize other reaction zones of a shaft furnace or of a blast furnace, it is possible for suitable introduction lines to be fitted at these locations.

A dedicated plant 3 for the generation of the shockwaves or for the introduction of the treatment gas may be connected to each lance 2 or introduction point. Depending on the amount of treatment gas required, the shockwave intensity and the size or extent of the furnace, one plant 3 may provide a supply to multiple lances 2 or multiple introduction points. It is thus also possible for a supply to be provided to all of the lances 2 or introduction points by the same plant 3 via a ring line around the circumference of the furnace 1. It should be ensured that the generation of the shockwaves and the introduction into the furnace 1 do not take place at a great distance from one another, because the intensity of the shockwaves decreases with the distance travelled.

The plant 3 is connected to a supply line 8 which ensures that the plant 3 is supplied with the required amount of gas and the required gas pressure. The gas pressure of the pressure reservoir, in this case in the form of a pressure vessel 6 with associated pipeline, may for example be 10 bar, in particular at least 20 bar or higher.

The generation of shockwaves or the intermittent introduction of the gas is made possible by way of a fast-opening valve 9. In particular in order to realize the required amount of propellant gas, it is ideally the case that the pressure vessel 6—which is where possible charged with a defined pressure by way of a regulation means—positioned upstream of the valve 9. For this purpose, a pressure regulator 7 may be provided either in a feed line 10 directly upstream of the pressure vessel 6, in the supply line 8, or in a supply line of multiple such plants 3.

The plant 3 may furthermore be equipped with a regulated system 5 for the additional continuous introduction of treatment gas, said regulated system being situated in a bypass line 11. The required gas volume flow is set by way of a regulating fitting. Alternatively, for the continuous gas flow, use may be made—by contrast to the illustration in FIG. 1—of a gas other than that used for the generation of the shockwaves. In this case, an additional feed line is required.

The plant 3 is connected to a suitable line 4 and to the lances 2 or introduction points such that both the generated shockwaves or the intermittent gas flow and the continuous gas flow can be introduced into the furnace 1.

The plant 3 is furthermore equipped with an electronic controller 12. In the case of multiple plants 3 being used, for example if each lance or introduction point is equipped with a dedicated plant 3, use is ideally made of an additional superordinate controller.

What is claimed is:

1. A method for operating a shaft furnace, comprising:

introducing at least one gas into the furnace; and introducing shockwaves into the furnace, by opening a closable valve from a fully closed state to a fully opened state in less than 6 milliseconds.

2. The method of claim 1, wherein said closable valve is pneumatically controlled.

3. The method of claim 1, wherein said shockwaves are generated from a pressure reservoir having pressurized gas contained therein that has an internal gas pressure of at least 10 bar.

4. The method of claim 3, wherein the pressurized gas contained in the pressure reservoir, which is used to generate the shockwaves into the furnace, is a treatment gas required for a reaction process in the furnace.

5. The method of claim 1, wherein subsequent to said opening step, holding open the closable valve for a time period between 0.05 seconds and 0.7 seconds.

6. The method of claim 1, wherein said at least one gas is a gas with oxidizing action.

* * * * *